US006118210A

United States Patent [19]

Le Gars

[11] Patent Number: 6,118,210

[45] Date of Patent: Sep. 12, 2000

[54] LIGHT-EMITTING DISPLAY PANEL

[75] Inventor: Jacques Le Gars, Gambais, France

[73] Assignee: Societe d'Exploitation du Mobilier a Usage Public, France

[21] Appl. No.: 09/114,237

[22] Filed: Jul. 1, 1998

[30] Foreign Application Priority Data

Jul. 4, 1997 [FR] France ..... 97 08505

[51] Int. Cl.[7] ..... H01J 5/16

[52] U.S. Cl. ..... 313/112; 313/479; 362/293; 359/885

[58] Field of Search ..... 313/112, 479, 313/495, 507; 359/885, 308, 614; 362/293

[56] References Cited

U.S. PATENT DOCUMENTS

| | | | |
|---|---|---|---|
| 3,736,050 | 5/1973 | Bolum | 313/112 |
| 4,142,126 | 2/1979 | DuBois | 313/112 |
| 5,023,763 | 6/1991 | Le Gars | 362/240 |

FOREIGN PATENT DOCUMENTS

| | | |
|---|---|---|
| 0 365 429 | 10/1989 | European Pat. Off. . |
| 2 638 271 | 10/1988 | France . |
| 30 37 500 | 4/1981 | Germany . |
| 42 25 140 | 2/1994 | Germany . |

*Primary Examiner*—Ashok Patel
*Attorney, Agent, or Firm*—Piper Marbury Rudnick & Wolfe

[57] ABSTRACT

A light-emitting display panel comprising an opaque background having a front face of dark color fitted with a plurality of light-emitting elements, the front face and the light-emitting elements being covered by a front optical filter. The front optical filter is a substantially neutral absorbant filter having a transmission coefficient lying in the range 10% to 60% over substantially the entire visible light spectrum, the display panel not having any other optical filter interposed between the background and the front optical filter.

6 Claims, 1 Drawing Sheet

LIGHT-EMITTING DISPLAY PANEL

FIELD OF THE INVENTION

The present invention relates to light-emitting display panels, and in particular to such panels that comprise an opaque background having a front face of dark color and provided with a plurality of light-emitting elements, said front face and the light-emitting elements being covered by a front optical filter.

BACKGROUND OF THE INVENTION

Document FR-A-2 638 271 describes an example of such a light-emitting display panel, in which the front optical filter is substantially the same color as the light-emitting elements. Furthermore, in that display panel, an additional optical filter is interposed between the front optical filter and the opaque background, said additional optical filter being of a color that is complementary to the color of the front optical filter and being pierced by holes in register with the light-emitting elements.

That known display panel gives satisfaction since it is very legible, even in full sunlight, because of the large amount of contrast obtained between the light-emitting elements and the opaque background.

Nevertheless, that display panel suffers from the following drawbacks:

- it is well adapted to monochrome light-emitting elements, but it is poorly adapted to displaying in a plurality of colors; and
- the additional optical filter is relatively expensive, insofar as it needs to be pierced with holes.

OBJECTS AND SUMMARY OF THE INVENTION

A particular object of the present invention is to mitigate those drawbacks.

To this end, according to the invention, in a display panel of the kind in question, the front optical filter is a substantially neutral absorbant filter having a transmission coefficient lying in the range 10% to 60% over substantially the entire visible light spectrum, the display panel not having any other optical filter interposed between the background and said front optical filter.

By means of these dispositions, a display panel is obtained which always provides excellent visibility, enabling a large amount of contrast to be obtained between the light-emitting elements and the opaque background, and furthermore the display panel can lend itself, where appropriate, to a color display, and it is less expensive than the above-mentioned display panels.

In preferred embodiments of the invention, use may optionally be made of one or more of the following dispositions:

- the transmission coefficient of the front filter lies in the range 12% to 40% over substantially the entire visible light spectrum;
- the front optical filter is of a chestnut-brown color;
- the light-emitting elements are adapted to emit light mainly at a wavelength lying in the range 500 nm to 650 nm;
- the front face of the opaque background is black;
- the background is constituted by a plate carrying the light-emitting elements and which forms an electrical circuit for feeding power to said light-emitting elements; and
- the background comprises a mask pierced by holes disposed in register with the light-emitting elements, said mask forming the front face of the background.

BRIEF DESCRIPTION OF THE DRAWINGS

Other characteristics and advantages of the invention appear from the following detailed description of two embodiments, given as non-limiting examples with reference to the accompanying drawing.

In the drawing.

MORE DETAILED DESCRIPTION

In the various figures, the same references are used to designate elements that are identical or similar.

Figure 1:
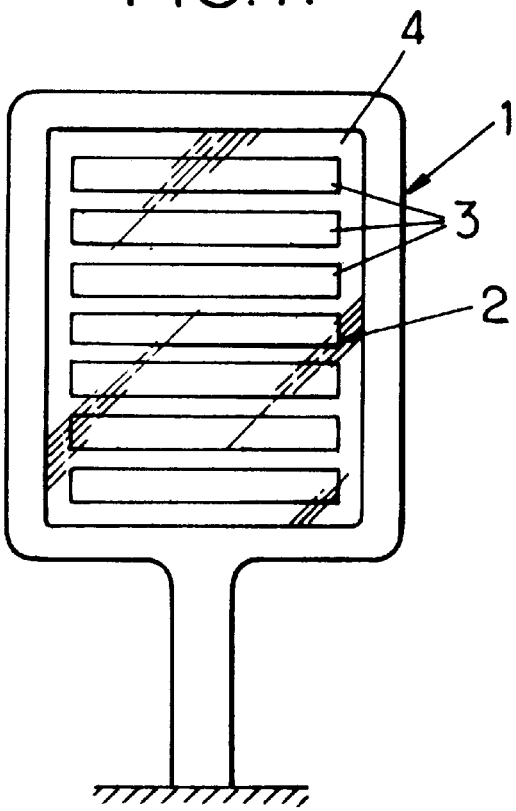
FIG. 1 is a diagrammatic view showing an example of a light-emitting display panel of the invention.

FIG. 1 shows an example of a light-emitting display panel 1 of the invention, suitable for being set up in an urban area to broadcast information to users of the public highway.

Naturally, the invention is not limited to that particular type of light-emitting display, but on the contrary covers any type of light-emitting display panel for setting up specifically in the open air and/or in public places (streets, main roads, freeways, airports, stations, etc.) to broadcast information or publicity messages, for example.

The display panel 1 comprises a transparent front face 2 constituted in this case by an optical filter of a chestnut-brown color covering sets 3 of light-emitting elements disposed on the front face of an opaque background 4.

Figure 2:
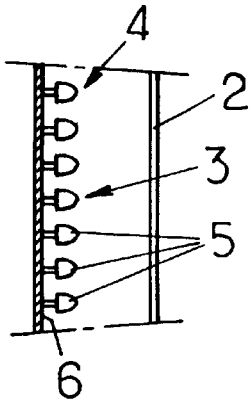
FIG. 2 is a fragmentary section view showing the inside of the FIG. 1 display panel in a first embodiment of the invention.

As shown in FIG. 2, each set 3 of light-emitting elements is constituted by a plurality of light-emitting elements 5, e.g. light-emitting diodes (LEDs) which can be carried by the background 4, which background 4 is then advantageously constituted by a printed circuit plate 6 adapted to feed electricity to each of the LEDs 5.

The front face of the plate 6, i.e. the face of the plate looking towards the filter 2, is of a dark color, and advantageously black.

Figure 3:
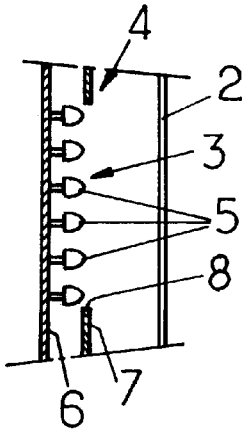
FIG. 3 is a view similar to FIG. 2 for a second embodiment of the invention.

In a variant, as shown in FIG. 3, the background 4 may comprise not only the printed circuit plate 6, but also a mask 7 pierced by holes 8 in register with the LEDs 5 or in register with sets 3 of LEDs.

Under such circumstances, the front face of the mask 7, i.e. the face of the mask looking towards the filter 2 is of a dark color, advantageously black, and the printed circuit plate 6 may possibly be of any color.

The LEDs 5 preferably emit light mainly at a wavelength peak lying in the range 500 nanometers (nm) to 650 nm, and advantageously situated at about 590 nm (yellow light).

By way of example, the LEDs 5 may be AlInGaP technology diodes as sold in particular by TOSHIBA under the reference S4E38XX.

The optical filter 2 is an absorbant filter of substantially neutral color, i.e. it absorbs light over the entire visible spectrum, and more particularly it transmits 10% to 60% of the light it receives over substantially all of the visible light spectrum (400 nm to 800 nm).

By way of example, the optical filter 2 may be the filter sold under the reference PLEXIGLAS GS UMBRA 806 by ROHM.

Figure 4:
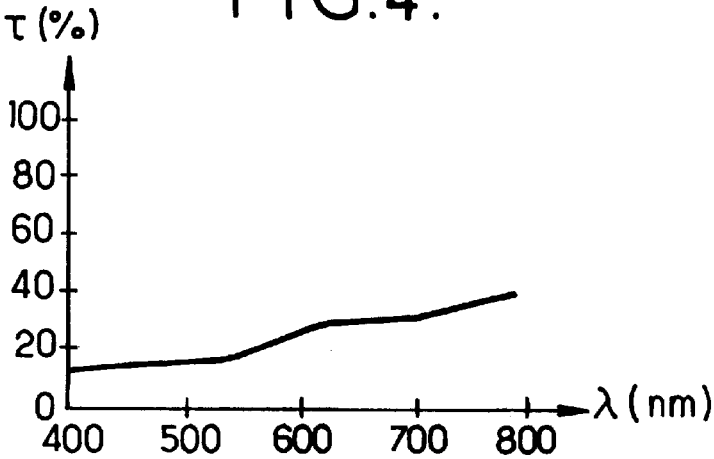
FIG. 4 shows an example of the absorption spectrum of the front optical filter belonging to the FIG. 1 display panel.

As shown in FIG. 4, the transmission coefficient $\tau$ of this particular filter lies in the range 12% to 40% for light wavelength $\lambda$ lying in the range 400 nm to 800 nm.

It is thus possible to obtain a very high level of contrast between the LEDs 5 and the background 4, thereby imparting excellent legibility to the display panel, even in full sunlight, and achieving this without increasing the power of the diodes 5.

For example, from outside the panel 1, it has been possible to measure luminance LD of the LEDs 5 of 2900 candelas per square meter (cd/m$^2$) under ambient lighting of 100,000 lux, thus giving contrast of (LD+LF)/LF of 13.8, where LF is the luminance of the background 4, which ensures excellent legibility.

Under the same conditions, but with the optical filter 2 being replaced by colorless glass, the contrast is no more than 3.5, and the display panel is illegible.

What is claimed is:

1. A light-emitting display panel, comprising:

an opaque background having a front face of dark color;

a plurality of light-emitting elements fitted to the front face; and a single optical filter, the single optical filter covering the front face and the light-emitting elements, wherein the single optical filter is a chestnut-brown color substantially neutral absorbent filter having a transmission coefficient lying in the range 10% to 60% over substantially the entire visible light spectrum, the display panel not having any other optical filter interposed between the background and said front optical filter.

2. A display panel according to claim 1, in which the transmission coefficient of the single optical filter lies in the range 12% to 40% over substantially the entire visible light spectrum.

3. A display panel according to claim 1, in which the light-emitting elements are adapted to emit light mainly at a wavelength lying in the range 500 nm to 650 nm.

4. A display panel according to claim 1, in which the front face of the opaque background is black.

5. A display panel according to claim 1, in which the background is constituted by a plate carrying the light-emitting elements and which forms an electrical circuit for feeding power to said light-emitting elements.

6. A display panel according to claim 1, in which the background comprises a mask pierced by holes disposed in register with the light-emitting elements, said mask forming the front face of the background.

* * * * *